US012653225B2

(12) United States Patent
Kitaoka

(10) Patent No.: US 12,653,225 B2
(45) Date of Patent: Jun. 16, 2026

(54) AEROSOL-GENERATING ARTICLE WRAPPER COMPRISING HEAT SENSITIVE INDICATION MEANS

(71) Applicant: JT International SA, Geneva (CH)

(72) Inventor: Ryo Kitaoka, Tokyo (JP)

(73) Assignee: JT International SA, Geneva (CH)

( * ) Notice: Subject to any disclaimer, the term of this patent is extended or adjusted under 35 U.S.C. 154(b) by 649 days.

(21) Appl. No.: 17/635,915

(22) PCT Filed: Aug. 20, 2020

(86) PCT No.: PCT/EP2020/073322
§ 371 (c)(1),
(2) Date: Feb. 16, 2022

(87) PCT Pub. No.: WO2021/037661
PCT Pub. Date: Mar. 4, 2021

(65) Prior Publication Data

US 2022/0330605 A1 Oct. 20, 2022

(30) Foreign Application Priority Data

Aug. 23, 2019 (EP) ..... 19193387

(51) Int. Cl.
*A24D 1/02* (2006.01)
*D21H 19/20* (2006.01)
*D21H 21/14* (2006.01)

(52) U.S. Cl.
CPC ..... *A24D 1/025* (2013.01); *D21H 19/20* (2013.01); *D21H 21/14* (2013.01)

(58) Field of Classification Search
None
See application file for complete search history.

(56) References Cited

U.S. PATENT DOCUMENTS 4,607,647 A * 8/1986 Dashley ..... A24D 1/02 131/365
4,987,908 A * 1/1991 Sprinkel ..... A24D 1/22 131/365

(Continued)

FOREIGN PATENT DOCUMENTS

CN 1198309 A 11/1998
CN 103073949 A 5/2013

(Continued)

OTHER PUBLICATIONS

Anthony Bristow, Ch. 5 (28 pgs total) Pulp and Paper Chemistry and Technology, vol. 4 (Ed. by Monica Ek, Goran Gellerstedt, Gunnar Henriksson), ISBN 978-3-11-021345-4), copyright 2009: see esp. "Standardized Measurement Conditions (ISO 2469)" and "Optical Measurements" at pg. numbers 156-160. (Year: 2009).*

(Continued)

*Primary Examiner* — Dionne W. Mayes
(74) *Attorney, Agent, or Firm* — Lerner David LLP

(57) ABSTRACT

A wrapper for an aerosol-generating article includes at least one coated surface area and at least one non-coated surface area, wherein the coating of the at least one coated surface area of the wrapper is heat-sensitive, wherein the coating indicates heat application by a permanent color change. An aerosol generating article includes such a wrapper. A method for producing an aerosol generating article includes such a wrapper by printing a polymer on parts of the wrapper by flexography.

19 Claims, 3 Drawing Sheets

(56) References Cited

U.S. PATENT DOCUMENTS

Figure 1A:
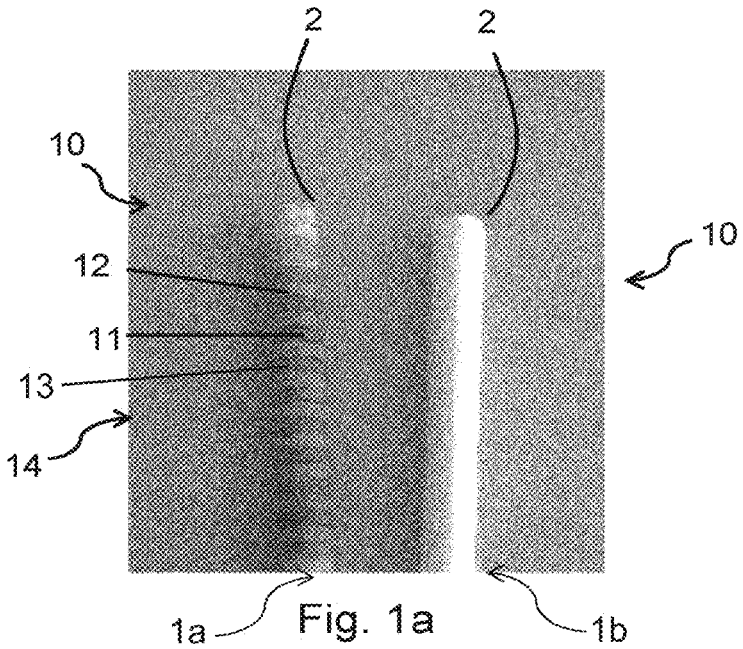

| | | | | |
|---|---|---|---|---|
| 6,207,601 | B1 * | 3/2001 | Maurer | D04H 1/425 428/401 |
| 2007/0215167 | A1 | 9/2007 | Llewellyn Crooks et al. | |
| 2010/0180903 | A1 * | 7/2010 | Cooper | A24D 1/025 131/365 |
| 2015/0173416 | A1 * | 6/2015 | Zitturi | A24D 1/02 131/365 |
| 2018/0007959 | A1 | 1/2018 | Lavanchy et al. | |
| 2020/0268039 | A1 | 8/2020 | Lavanchy | |

FOREIGN PATENT DOCUMENTS

| | | | | |
|---|---|---|---|---|
| CN | 107148224 | A | 9/2017 | |
| CN | 108366617 | A | 8/2018 | |
| EP | 0409566 | A1 * | 1/1991 | A24D 1/22 |
| WO | 9944447 | A1 | 9/1999 | |
| WO | WO-2016166064 | A1 * | 10/2016 | A24F 40/10 |
| WO | 2017114895 | A1 | 7/2017 | |
| WO | 2019129378 | A1 | 7/2019 | |

OTHER PUBLICATIONS

Measuring Brightness on KODAK Bright White Paper, date at least as early as Mar. 27, 2020: https://kodakassist.freshdesk.com/support/solutions/articles/48001068022-measuring-brightness-on-kodak-bright-white-paper, accessed Jul. 11, 2024. (Year: 2024).*

Quick facts—Paper Whiteness Explained: https://www.hpplotter.co.uk/worldofhp/whiteness, accessed Jul. 11, 2024. (Year: 2024).*

Brightness levels—and what it actually means: https://www.hpplotter.co.uk/worldofhp/brightness-and-how-it-impacts-you, accessed Jul. 11, 2024. (Year: 2024).*

Search Report dated Nov. 19, 2023 from the Office Action for Chinese Application No. 202080059676.1 ssued Nov. 28, 2023, pp. 1-3.

Ji, Y. et al., "Investigation of thermogravimetry and pyrolysis behavior of tobacco material in two heat-not-burn cigarette brands" Chinese Journal of Tobacco, Acta Tabacaria Sinica, China Academic Journal Electronic Publishing House, Dec. 2015, pp. 7-13, vol. 21, No. 6. English Translation of Abstract only.

Wanchun, Z. et al., "Effects of High Molecular Weight Polymer on Growth, Yield and Quality of Flue-cured Tobacco" Chinese Tobacco Science, China Academic Journal Electronic Publishing House, Dec. 2007, pp. 32-35, vol. 28, No. 1. 1. English Translation of Abstract only.

International Search Report for Application No. PCT/EP2020/073322 mailed Nov. 17, 2020, pp. 1-3.

* cited by examiner

AEROSOL-GENERATING ARTICLE WRAPPER COMPRISING HEAT SENSITIVE INDICATION MEANS

CROSS-REFERENCE TO RELATED APPLICATIONS

The present application is a national phase entry under 35 U.S.C. § 371 of International Application No. PCT/EP2020/073322, filed Aug. 20, 2020, published in English, which claims priority to European Application No. 19193387.8 filed Aug. 23, 2019, the disclosures of which are incorporated herein by reference.

FIELD OF INVENTION

The present invention relates to a wrapper for an aerosol-generating article and a method for producing such a wrapper according to the preamble of present claims 1 and 12.

Furthermore, the present invention relates to an aerosol-generating smoking article comprising a wrapper according to the preamble of present claim 1.

BACKGROUND ART

Aerosol-generating articles are produced in large quantities. Examples for aerosol-generating articles are well-known cigarettes, cigars (in different sizes and shapes like parejos, cigarillos, figurados and others) as well as recently marketed heat-not-burn articles, which structurally resemble cigarettes and comprise a charge of aerosol-generating material, possibly containing tobacco material, usually wrapped with a paper-based wrapper in a rod, and connected with a tipping wrapper to a filter segment. These heat-not-burn articles are designed for the aerosol-generating material to be heated with an electrically powered heating device in order to generate an aerosol that can be inhaled by a consumer through a mouthpiece, possibly formed by said filter. The heating of the aerosol generating material, usually limited to temperatures below 400° C., preferably between 250° C. and 350° C., does not lead to combustion of the aerosol generating material nor its circumscribing wrapper.

In most cases, the wrapper is the largest external surface of the aerosol-generating article. Usually, large parts of the external surface of the wrapper could be seen by the consumer or other persons prior or during usage of the aerosol-generating article. Thus, it is highly appreciated to provide visual effects on the cigarette paper to allow delimitation with respect to cigarettes from other brands or to provide additional information for the consumer. These visual effects could further generate a premium appearance of the aerosol-generating article.

Especially for heat-not-burn aerosol-generating articles, the wrapper may remain unchanged during use of the aerosol-generating article by the consumer. Thus, it may be difficult for a user to differentiate between new and used articles.

It is known from the state of the art that information for the consumer could be provided on aerosol generating article wrappers. By way of example, embossed wrappers have been developed in the past. The information could be provided by embossing letters or other symbols on the wrapper. However, the perceptibility for a consumer is very limited.

It is further known in the art to provide smoking articles comprising thermochromic material provided on an outer wrapper to provide indication that a said smoking article has already been used. Examples of such use indicative techniques are for example provided in WO 99/44447 A1 or WO 2017/114895 A1 for instance. However, the thermochromic materials used involve complex chemical substances (liquid crystals, leuco dyes, metal complexes), which are costly to produce and implement.

Thus, it is the objective of the present invention to provide a wrapper, which could be used in an aerosol generating article which allows easy differentiation between new and used products and is very easy and cheap to produce compared to the techniques known from the prior art.

SUMMARY OF THE INVENTION

The afore-mentioned problems are solved by a wrapper according claim 1, an aerosol-generating article according to claim 10 and a method according to claim 12.

A wrapper according to the invention comprises at least one coated surface area and at least one non-coated surface area, wherein the coating of the at least one coated surface area of the wrapper is heat sensitive. The coating indicates heat application by a permanent colour change. Preferably the structure of the wrapper as such remains unchanged. This means that the wrapper is not burnt. This prevents production of ashes. Furthermore, the persisting structure of the wrapper facilitates replacement of the wrapped product (e.g. the tobacco stick) after usage. The coating which generates the permanent colour change could be arranged on the base of the wrapper in form of letters or symbols. Thus, it is possible that text or other recognizable hints for a user could appear during or after usage of the wrapped product. An example for a suitable text which could appear during heat application is the word "used" or other similar words, texts or symbols which clearly indicate to the user that the product has already be used.

According to the invention, the heat-sensitive coating provides indication of a heat application by a permanent difference of brightness of the coated surface area, wherein the difference of brightness measured according to ISO 2469 after heating is at least 1%, preferably at least 2%, more preferably at least 3%. It has been found that a change of brightness of the coated surface area could be especially easy recognized by users. Furthermore, substances which perform a change of brightness are convenient for usage in combination with tobacco products since they do not (at least significantly) impair the flavour of the tobacco.

Preferably, the coating comprises a polymer. Polymers are available in a very wide range of different compositions. Thus, the properties could be designed easily in a suitable way. Some polymers are even preferred since their usage in the tobacco industry has already been approved. Accordingly, the polymer is preferably selected from a group comprising EVA, PVA, any other copolymer of ethylene, any other copolymer of propylene, PE, and any other film forming polymer. These polymers are especially suitable since their impact on the taste of the aerosol is minimal.

In a preferred embodiment of the wrapper, the coating provides indication of heat application after heat application by a temperature of at least 150° C. Thus, erroneous indication of prior usage could be reliably avoided. Since often high temperatures occur during handling or transport of the wrapper (e.g. during shipment in containers), a quite high temperature of at least 150° C. for initiation of the colour change has been found to be preferred. Even more preferably, the (activation) temperature is between 160 and 250° C., more preferably in the range from 170 to 250° C. It has been found, that these temperatures are suitable for releasing all desired flavours from the heated substrate (e.g. tobacco) and avoid evaporation of undesired substances or ignition of the tobacco or the wrapper.

To avoid erroneous indication of prior usage, a coating is selected that provides indication of heat application after heat application of at least 3 minutes. Thus, it could be avoided that very short traversal of the minimum temperature for initiating the indication of heat application does not result in erroneous indication of prior usage. Since the consumption of a tobacco product usually takes at least 3 minutes it is preferred that shorter traversal of the minimum temperature does not result in the permanent color change of the coating. Preferably, traversal of the minimum temperature has to take place for between 5 and 15 minutes, more preferably between 5 and 10 minutes to initiate the permanent color change of the coating.

In a preferred embodiment of the wrapper, the coating is provided in the coated surface area in an amount of 0.5 to 20 $g/m^2$, preferably 2 to 15 $g/m^2$, more preferably 4 to 10 $g/m^2$. It has been shown, that these amounts of coating do not negatively influence the permeability of the wrapper. Thus, a continuous flow of the aerosol during usage of the aerosol-generating article by the user could be ensured.

Preferably, the difference between the opacity according to ISO 2471 of the coated surface area and the non-coated surface of the not heat-treated wrapper is less than 3%. As mentioned above, it is not desired that the brownish tobacco colour could be seen through some areas of the wrapper. Thus, (semi-) transparent segments should be avoided. In contrast to (semi-) transparent segments, it is desired to provide a homogeneous appearance of the surface of the wrapper in the not heat-treated (or unused) state. Since the consumers are used to homogeneous wrapper surfaces, which are mostly white, brownish areas could be considered to be dirty or even unhygienic. To maintain such a homogeneous appearance, the difference between the opacity according to ISO 2471 of the coated surface area and the non-coated surface of the not heat-treated wrapper is preferably less than 2%, more preferably less than 1%.

Preferably, the difference between the opacity according to ISO 2471 of the coated surface area and the non-coated surface of the heat-treated wrapper is less than 3%. Since the wrapper is (at least in some embodiments of the invention) not burnt, it is preferred that after usage of the wrapper-enclosed product, the difference between the opacity according to ISO 2471 of the coated surface area and the non-coated surface is very little. As mentioned above, it is not desired that the brownish tobacco colour could be seen through some areas of the wrapper. Thus, (semi-) transparent segments should be avoided. In contrast to (semi-) transparent segments it is desired to provide a homogeneous appearance of the surface of the wrapper in the not heat-treated (or unused) state. Since the consumers are used to homogeneous wrapper surfaces, which are mostly white, brownish areas could be considered to be dirty or even unhygienic. Preferably, the difference between the opacity according to ISO 2471 of the coated surface area and the non-coated surface of the heat-treated wrapper is even less than 2%, more preferably less than 1% after heat application by a temperature of at least 150° C., preferably between 160 and 250° C., more preferably in the range from 170 to 250° C.

Preferably, the coating is suitable for being applied by known printing processes, preferably flexography. This facilitates handling and application of the coating and allows parallelization, automatization and high-throughput.

To facilitate handling of the coating prior its application, the viscosity is preferably in the range between 200 and 2000 mPas, preferably between 300 and 1000 mPas, more preferably between 400 and 700 mPas.

In a preferred embodiment of the wrapper, the coated surface area comprises a coating of 0.5 to 20 $g/m^2$, preferably of 2 to 15 $g/m^2$, more preferably of 4 to 10 $g/m^2$. It has been found that at these application weights the desired glossiness could be provided at minimal material costs.

Preferably, the wrapper comprises a paper. More preferably the paper is a carrier, on which the coating is applied. Since papers are well known in the tobacco industry, this allows handling of the wrapper with known machines and handling apparatus.

In a preferred embodiment, the paper has an opacity of more than 60%, preferably more than 70%, more preferably more than 75%. Thus, it could be avoided that brownish tobacco colour could shine through the (uncoated) paper. Furthermore, papers having a high opacity are considered to relate to high-value and/or premium-quality products.

A second aspect of the present invention relates to an aerosol-generating article, which comprises a wrapper as described above. An aerosol-generating article comprising such a wrapper provides the possibility to easily distinguish between used and not-used (tobacco) products. Furthermore, (semi-) transparent parts could be omitted. This provides a high-value and/or premium-quality appearance and could easily be recognized by the consumer. Such aerosol-generating article does not have the disadvantage that the brownish tobacco colour could be seen through the wrapper. Thus, brownish areas, which probably could be considered to be dirty or even unhygienic, are obviated. This increases a high-value and/or premium-quality appearance.

In a preferred embodiment of the aerosol-generating article, it comprises an aerosol-generating substrate, wherein the aerosol-generating substrate is wrapped in the wrapper as described above. Thus, the aerosol-generating substrate is wrapped in the wrapper and could easily be handled. This facilitates substitution of a used aerosol-generating substrate by a new one.

Preferably, the aerosol-generating substrate comprises tobacco or a tobacco extract. Thus, the wrapped tobacco or tobacco extract could easily be handled by the user.

Preferably, the wrapper and the aerosol-generating substrate are parts of a cartridge, which could be connected with the respective mount of the aerosol-generating article. Since such a cartridge is usually designed for unique usage, a new cartridge comprising a wrapper as described above, could easily be distinguished from already used ones.

In a preferred embodiment of the aerosol-generating article, a coating of the wrapper indicates heat application through color change after heat application of at least 3 minutes. Thus, it could be avoided that short traversal of the minimum temperature for less than 3 minutes would initiate the erroneous indication of heat application without usage of the aerosol-generating substrate (and/or the cartridge). Since the consumption of a tobacco product usually takes at least 3 minutes it is preferred that shorter traversal of the minimum temperature as it might occur during handling and/or shipping does not result in the permanent color change of the coating. Preferably, traversal of the minimum temperature has to take place for between 5 and 15 minutes, more preferably between 5 and 10 minutes to initiate permanent color change of the coating.

A further aspect of the current invention relates to a method for producing an aerosol-generating article comprising a wrapper, wherein the wrapper comprises at least one coated surface area and at least one non-coated surface area. The at least one coated surface area comprises a heat sensitive coating, which is applied by printing, preferably by flexography and wherein the heat sensitive coating provides indication of a heat application by a permanent difference of brightness of the coated surface area, wherein the difference of brightness measured according to ISO 2469 after heating is at least 1%, preferably at least 2%, more preferably at least 3%. A printing process, especially flexography is preferred, since it allows local application of a coating, preferably polymers. Since these techniques are usually available in production sites for handling wrappers and/or papers, no additional machines or apparatus are necessary. Furthermore, flexography allows very fast printing and high throughput. This is especially desired for a mass product like wrappers for tobacco (containing) sticks.

In a preferred embodiment the method comprises the step of selecting a suitable heat-sensitive coating. This heat sensitive coating comprises preferably a polymer. The polymer is preferably selected from a group comprising EVA, PVA, any other copolymer of ethylene, any other copolymer of propylene, PE, and any other film forming polymer. These polymer have been found to be especially suitable for printing processes, especially for flexography.

In a preferred embodiment of the method, the polymer is printed as emulsion, suspension or in molten form. This facilitates handling and even distribution of the polymer. Preferably, the emulsion, suspension or the molten polymer is dried after its application on the (base) paper. In a further preferred embodiment, this is performed under at least temporally increased pressure. At least in some cases, the increased pressure allows tighter bonding of the polymer to the paper. This improves heat transfer from the inner surface of the wrapper to its outer surface.

All disclosed features relating to the method shall apply mutatis mutandis to the wrapper and/or the aerosol-generating article and all disclosed features relating to the wrapper and/or the aerosol-generating article shall apply mutatis mutandis to the method.

DESCRIPTION OF THE APPENDED DRAWINGS

Further advantages, objectives and features of the present invention will be described, by way of example only, in the following description with reference to the appended figures. In the figures, like components in different embodiments can exhibit the same reference symbols.

Figure 1B:
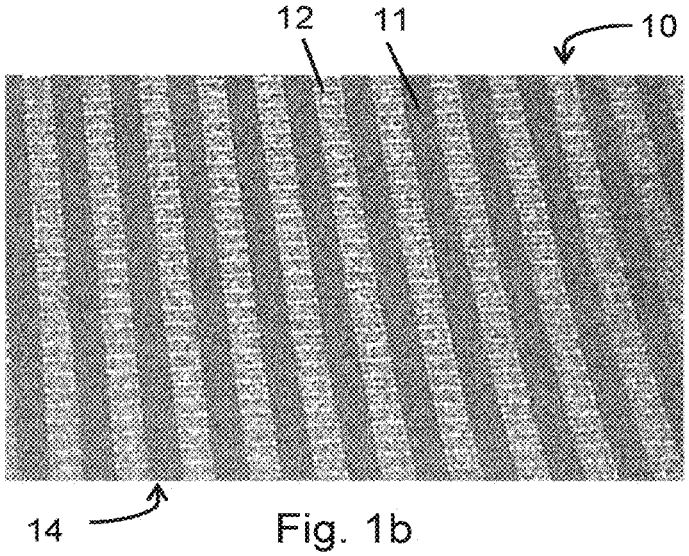
Figure 2A:
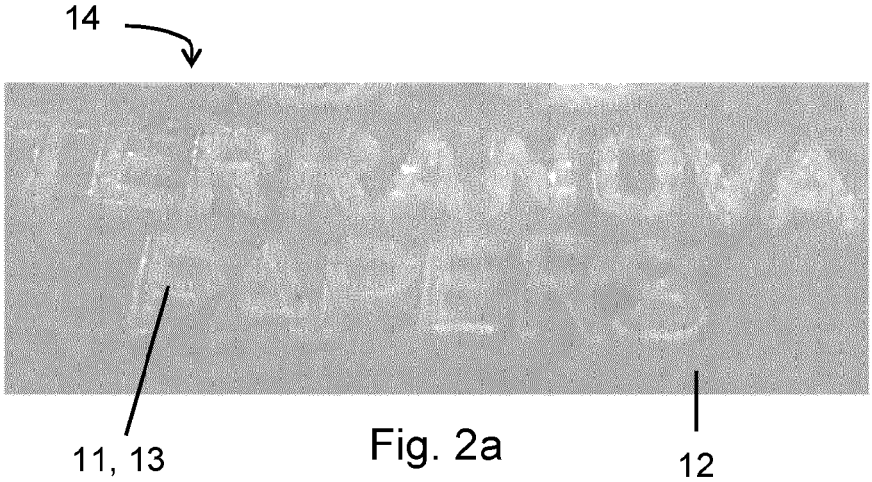
Figure 2B:
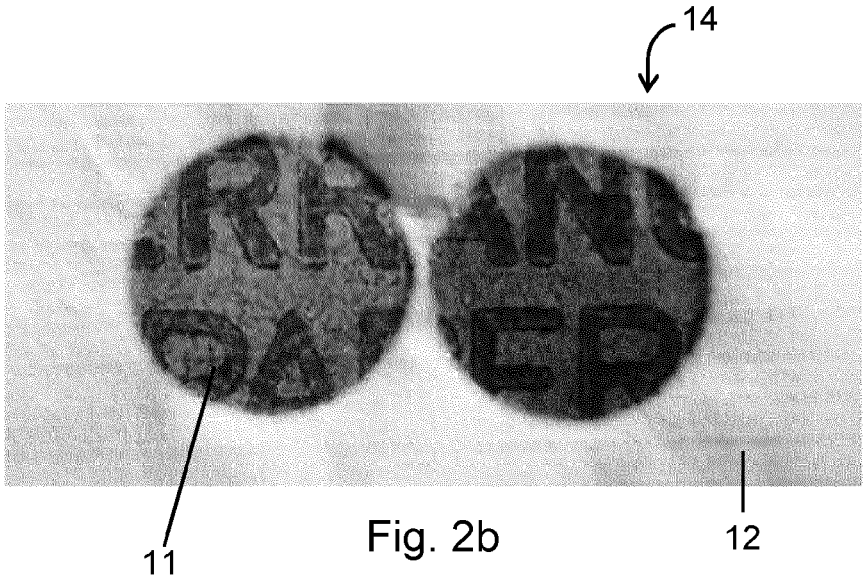

The figures show:

FIG. 1*a* an image of a used (left) and a not-used (right) aerosol-generating article;

FIG. 1*b* an image of a possible form of the coated surface of a wrapper;

FIG. 2*a* a detailed image of a possible form of the coated surface on a wrapper prior heat application;

FIG. 2*b* the detailed image of a possible form of the coated surface on a wrapper of FIG. 2*a* after heat application with two circular heat applicators;

FIG. 3*a*-3*g* detailed images of possible forms of the coated surface on a wrapper after heat application with a circular heat applicator.

DESCRIPTION OF PREFERRED EMBODIMENTS OF THE INVENTION

FIG. 1*a* shows an image of two aerosol-generating articles 1*a*, 1*b*, each surrounded by a wrapper 10 with coated 11 and non-coated 12 surface areas according to the invention. The wrapper 10 surrounds the lateral area of a cylinder 2 (geometrically in more detail: a right circular cylinder) made of tobacco (not shown).

The wrapper 10 is partially, namely in the coated areas 11, coated with a heat sensitive coating 13. In the illustrated embodiment, this coating is applied in parallel stripes onto the wrapper 10, which is then wound around the tobacco cylinder 2. In this curved form of the wrapper 10, the coated areas 11 surround the cylinder along its circumferential direction.

On the left side of FIG. 1*a* a used aerosol-generating article 1*a* is shown. In contrast thereto, the aerosol-generating article 1*b* on the right side is not used. While the coating 13 is merely slightly visible prior usage of the aerosol generating article 1*b* (right), the local coating 13 is clearly visible after usage (left). Since the coating 13 indicates heat treatment by a permanent colour change, the stripes along the circumference of the tobacco stick 1 appear during usage. Thus, even in the case that the aerosol-generating article 1 and/or the wrapper 10 is not burnt during consumption of the tobacco and/or usage of the aerosol generating article 1, the usage is clearly indicated. This indicator prevents confusion and repeated usage of a single aerosol generating article 1. The samples illustrated in FIG. 1*a* are made by using commercially available aerosol-generating articles, which have been wrapped with a wrapper 10 according to an embodiment of the invention. The aerosol-generating article shown on the left in FIG. 1*a* has been treated by a smoking device, which simulates usage/consumption by a user.

FIG. 1*b* shows a further embodiment of the wrapper 10. The pattern 14 of the coated areas 11 are stripes. Thus, such a cigarette paper 10 or a very similar cigarette paper 10 could have been used for production of the aerosol-generating article 1 as shown in FIG. 1*a*. A base paper was coated locally with a polymer. In this embodiment, a polymer was used, which was previously used in the tobacco industry as glue for attaching overlapping ends of a cigarette paper onto each other. The application was performed by printing, in this case by flexography. The polymer was applied at an amount of about 6 $g/m^2$ per printed area. In this embodiment about 43% (preferably between 40-50%) of the total upper surface of the (base) paper 10 was coated with the polymer.

In the embodiment of the wrapper 10 shown in FIG. 1*b*, the opacity of the coated 11 and the non-coated 12 area was measured. The difference between the measured opacity of these areas was very low. The opacity of the coated area 11 was determined to be 74.9% and the opacity of the non-coated area 12 was measured to be 75.6%.

FIG. 2*a* shows a detailed image of a possible form of the coated surface 13 on a wrapper 10 prior heat application. This sample was made based on a paper available from the company Miguel y Costas Group. In the illustrated embodiment the coating 13 is applied in a pattern 14 that forms letters on the substrate. Since a white or transparent polymer was used, the coating 13 is merely visible prior heat application. However, depending on the angle of light falling on the coating 13, it might be recognizable because of its glossiness.

FIG. 2*b* shows the same cut-out of a wrapper as shown in FIG. 2*a*. However, the cut-out shown in FIG. 2*b* is locally heated. For heat application, two circular heat sources (not shown) have been used. The heat-treated areas of the wrapper 10 are visible because the base paper as well as the coating 13 has changed its colour. However, the paper and the coating 13 have changed to different colours. Thus, the letters 14 become clearly visible. It should be noticed that the angle of light has been changed with respect to the illustration of FIG. 2*b*. At this angle, the glossiness of the coating 13 is not visible any more. Thus, the pattern 14 could not be seen or only be assumed in some non-heat-treated areas. In contrast thereto, the pattern is visible because of the different colours in the heat-treated areas.

FIG. 3*a*-3*g* illustrate the effect of different heat treatments. All FIGS. 3*a*-3*g* show detailed images of possible forms of the coated surface on a wrapper after heat application with a circular heat applicator. Also these samples were prepared based on the same paper available from the company Miguel y Costas Group. The treatment time and/or treatment temperature differs between the illustrated samples. The wrapper shown in FIGS. 3*a* and 3*b* have both been treated with a temperature of about 250° C. The wrapper shown in FIG. 3*a* has been treated for 60 seconds, while the wrapper shown in FIG. 3*b* was treated for 300 seconds. It could be seen that the pattern is not yet clearly visible after treatment of only 60 seconds (FIG. 3*a*) at this temperature. However, a longer treatment of 600 seconds initiates a significant colour change and the pattern 14 (letters) becomes visible.

Figure 3A:
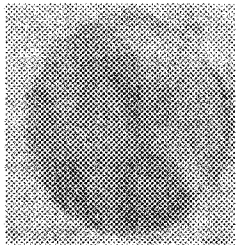
Figure 3B:
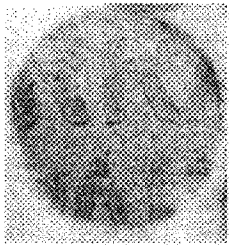
Figure 3C:
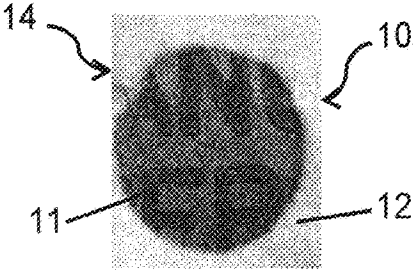
Figure 3D:
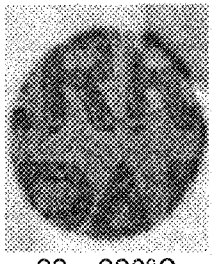
Figure 3E:
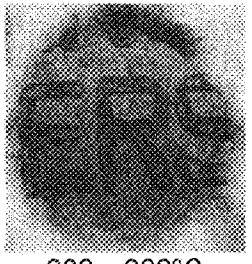

After treatment of the wrapper 10 with a heat applicator of 300° C. the pattern will already be visible after a treatment of only 30 seconds (FIG. 3*c*). However, longer treatments of 60 seconds (FIG. 3*d*) and 300 seconds (FIG. 3*e*) further increase the visibility. In FIG. 3*e* it could be seen that due to thermal radiation, also the surrounding areas of the wrapper 10 get brownish and the circular pattern of the heat applicator is inhomogeneous.

Figure 3F:
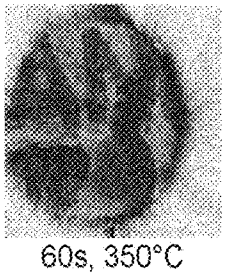
Figure 3G:
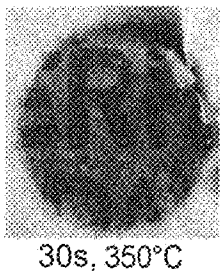

FIGS. 3*f* and 3*g* show the wrapper 10 after its treatment with a heat applicator of 350° C. The pattern could already be seen after a treatment of only 30 seconds (FIG. 3*f*) as well as after 60 seconds (FIG. 3*g*). However, both wrappers are locally burnt.

The polymer used for the coating as shown in FIGS. 3*a*-3*g* was EVA having a viscosity of 600 mPAs at 20° C. The solid content was 48% (w/w) and the application temperature was between 15 and 25° C. No colour change was visible for this polymer after heat treatment of 200° C. or below.

The applicant reserves his right to claim all features disclosed in the application document as being an essential feature of the invention, as long as they are new, individually or in combination, in view of the prior art. Furthermore, it is noted that in the figures features are described, which can be advantageous individually. Someone skilled in the art will directly recognize that a specific feature being disclosed in a figure can be advantageous also without the adoption of further features from this figure. Furthermore, someone skilled in the art will recognize that advantages can evolve from a combination of diverse features being disclosed in one or various figures.

LIST OF REFERENCE SYMBOLS

1 aerosol-generating article,
1*a* used aerosol-generating article,
1*b* unused aerosol-generating article,
2 cylinder
10 wrapper
11 coated surface area
12 non-coated surface area
13 coating
14 pattern

The invention claimed is:

1. A wrapper for an aerosol-generating article comprising:
at least one surface area, coated with a heat-sensitive polymer coating, that is configured to undergo a permanent color change after heating to an activation temperature of at least 150° C. for at least 3 minutes so as to avoid erroneous indication of prior usage; and
at least one non-coated surface area,
wherein the heat-sensitive polymer coating provides an additional indication of a heat application by a permanent difference of brightness of the at least one surface area, wherein the difference of brightness measured prior to heating to the activation temperature and after heating to the activation temperature for at least 3 minutes is at least 1%, and
wherein the wrapper remains structurally unchanged after heating to the activation temperature.

2. The wrapper according to claim 1, wherein:
the difference of brightness is at least 2%.

3. The wrapper according to claim 1, wherein:
the activation temperature in a range from 160 to 250° C.

4. The wrapper according to claim 1, wherein:
the activation temperature is in a range from 170° C. to 250° C.

5. The wrapper according to claim 1, wherein:
the heat-sensitive polymer coating includes at least one of EVA, PVA, any other copolymer of ethylene, any other copolymer of propylene, PE, or any other film forming polymer.

6. The wrapper according to claim 1, wherein:
the heat-sensitive polymer coating is provided on the at least one surface area in an amount of 0.5 to 20 g/m$^2$.

7. The wrapper according to claim 1, wherein:
a difference between opacity, measured according to ISO 2471, of the at least one surface area and the at least one non-coated surface area of the wrapper when the wrapper has not been heated to the activation temperature is less than 3%.

8. The wrapper according to claim 1, wherein:
a difference between opacity measured according to ISO 2471 of the at least one coated surface area and the at least one non-coated surface area of the wrapper after the wrapper is heated to the activation temperature for at least 3 minutes is less than 3%.

9. An aerosol-generating article comprising the wrapper according to claim 1.

10. The aerosol-generating article according to claim 9, further comprising:
an aerosol-generating substrate, wherein the aerosol-generating substrate is wrapped in the wrapper.

11. The wrapper according to claim 1, wherein:
the difference of brightness is at least 3%.

12. The wrapper according to claim 1, wherein:
the heat-sensitive polymer coating is configured to undergo after heat application of between 5 and 10 minutes.

13. The wrapper according to claim 1, wherein:
the heat-sensitive polymer coating is provided on the at least one surface area in an amount of 4 to 10 g/m$^2$.

14. The wrapper according to claim 1, wherein:
a difference between opacity, measured according to ISO 2471, of the at least one surface area and the at least one non-coated surface area of the wrapper when the wrapper has not been heated to the activation temperature is less than 1%.

15. The wrapper according to claim 1, wherein:
the heat-sensitive polymer coating comprises a copolymer, wherein the copolymer is at least one of EVA, a copolymer including an ethylene monomer, or a copolymer including a propylene monomer.

16. A method for producing an aerosol-generating article comprising a wrapper, wherein the wrapper comprises at least one surface area, coated with a heat-sensitive polymer coating, and at least one non-coated surface area, the method comprising:

applying, by flexography, the heat-sensitive polymer coating to the at least one surface area, wherein the at least one surface area, coated with the heat-sensitive polymer coating, is configured to undergo a permanent color change after heating to an activation temperature of at least 150° C. for at least 3 minutes application so as to avoid erroneous indication of prior usage, wherein the heat-sensitive polymer coating provides an additional indication of heat application by a permanent difference of brightness of the at least one surface area, wherein the difference in brightness prior to heating to the activation temperature and after heating to the activation temperature for at least 3 minutes is at least 1%, and wherein the wrapper remains structurally unchanged after heating to the activation temperature.

17. The method according to claim 16, wherein:

the heat-sensitive polymer coating comprises a copolymer, wherein the copolymer is at least one of EVA a copolymer including an ethylene monomer, or a copolymer including a propylene monomer.

18. The method according to claim 16, further comprising:

drying the heat-sensitive polymer coating after application to the wrapper.

19. The method according to claim 16, wherein:

the heat-sensitive polymer coating is provided in the at least one coated surface area in an amount of 0.5 to 20 $g/m^2$.

* * * * *